United States Patent [19]

Flavell et al.

[11] Patent Number: 4,730,756

[45] Date of Patent: Mar. 15, 1988

[54] UNFOLDING DEVICE

[75] Inventors: John Flavell; Michael A. Nash, both of Coventry, United Kingdom

[73] Assignee: Courtaulds Clothing Limited, England

[21] Appl. No.: 913,647

[22] PCT Filed: Jan. 13, 1986

[86] PCT No.: PCT/GB86/00019

§ 371 Date: Sep. 3, 1986

§ 102(e) Date: Sep. 3, 1986

[87] PCT Pub. No.: WO86/03948

PCT Pub. Date: Jul. 17, 1986

[30] Foreign Application Priority Data

Jan. 14, 1985 [GB] United Kingdom ..... 8500836

[51] Int. Cl.[4] ..... A41H 43/02

[52] U.S. Cl. ..... 223/37; 112/121.29

[58] Field of Search ..... 223/37, 1, 3, 38, 39, 223/43, 52.2, 52.3, 52.6; 112/2, 121.12, 121.29, 155

[56] References Cited

U.S. PATENT DOCUMENTS

| | | | |
|---|---|---|---|
| 3,099,970 | 8/1963 | Hite | 112/2 |
| 3,511,494 | 5/1970 | Szentkuti | 112/2 X |
| 3,789,781 | 2/1974 | Carson | 112/121.29 |
| 3,808,993 | 5/1974 | Heiler et al. | 112/155 |
| 4,097,973 | 7/1978 | Cho | 26/78 |

FOREIGN PATENT DOCUMENTS

| | | | |
|---|---|---|---|
| 0544365 | 4/1942 | United Kingdom . | |
| 1021888 | 3/1966 | United Kingdom | 112/121.29 |

*Primary Examiner*—Louis K. Rimrodt

*Attorney, Agent, or Firm*—Davis Hoxie Faithfull & Hapgood

[57] ABSTRACT

A method of unfolding a doubled piece of textile material (20), which comprises a first piece of material (21) and a further piece of material (22) disposed adjacent a surface (25) of the material (21), includes the steps of holding the first piece of material (21) so as to leave the further piece of material (22) free, and creating an air current, for example from a nozzle (4), to move the further piece of material (22) away from the surface (25).

16 Claims, 11 Drawing Figures

UNFOLDING DEVICE

TECHNICAL FIELD

This invention relates to the assembly of articles made from flexible material, for example garments, and is concerned with a method and device for unfolding a doubled piece of material comprising a first piece of material and a further piece of material lying adjacent a surface of the first piece of material. Such an unfolding procedure is required in the assembly of articles of the kind mentioned, for example, when two sheets of material, having been juxtaposed so that one lies on top of the other and seamed together along adjacent edges, must subsequently be passed to a further stage of assembly in a condition in which the two sheets of material are opened out, that is are unfolded one from the other. The method and device of the invention enable this unfolding to be done automatically, thus enabling a partly or fully automated system of assembly for textile articles, in particular garments, to be achieved.

SUMMARY OF THE INVENTION

According to the invention, a method of unfolding a doubled piece of flexible material comprising a first piece of material and a further piece of material disposed adjacent a surface of the first piece of material, includes the steps of holding the said first piece of material so as to leave the said further piece of material free and creating an air current to move the said further piece of material away from the said surface of the first piece of material.

The said first piece of material may be supported on a surface and clamped against the said surface by a presser element pressing it against the said surface in a region remote from a junction of the said first piece of material and the said further piece of material.

The said first piece of material may be clamped against a surface comprising a region located about the periphery of an aperture through which the said further piece of material can move before being moved by the said air current.

Another piece of material may lie adjacent the surface of the said first piece of material remote from the said further piece of material and a current of air may be arranged to move both the said further piece of material and the said other piece of material away from the said first piece of material.

The said further and the said other pieces of material may be moved by air currents to extend on opposite sides of a separating guide and the arrangement may be such as to subject the said pieces of material to suction so that they extend from the held first piece of material on opposite sides of the said separating guide and into a housing.

When the said further piece of material has been moved away from the said surface of the first piece of material, the said first piece of material may be moved over a supporting surface in a direction away from the said further piece of material causing said further piece of material to rest on the said surface in a flat condition extending away from the said first piece of material.

Means may be provided to press the unfolded piece of material against the said surface in a manner such as to hold it in a flat, opened out condition.

The invention includes apparatus for unfolding a doubled piece of flexible material in the manner described above. Such apparatus may include a presser element for pressing the folded piece of material against a surface, at least one displaceable part of the presser element being displaceable to release the said further piece of material for movement by an air current.

The presser element may have attached to it an auxiliary presser element arranged for pressing said further piece of material against a surface after unfolding.

The said auxiliary presser element may be releasably attachable to the said presser element.

BRIEF DESCRIPTION OF THE DRAWINGS

The invention will be further described by way of example, with reference to the accompanying drawings in which.

DESCRIPTION OF PREFERRED EMBODIMENT

Figure 1:
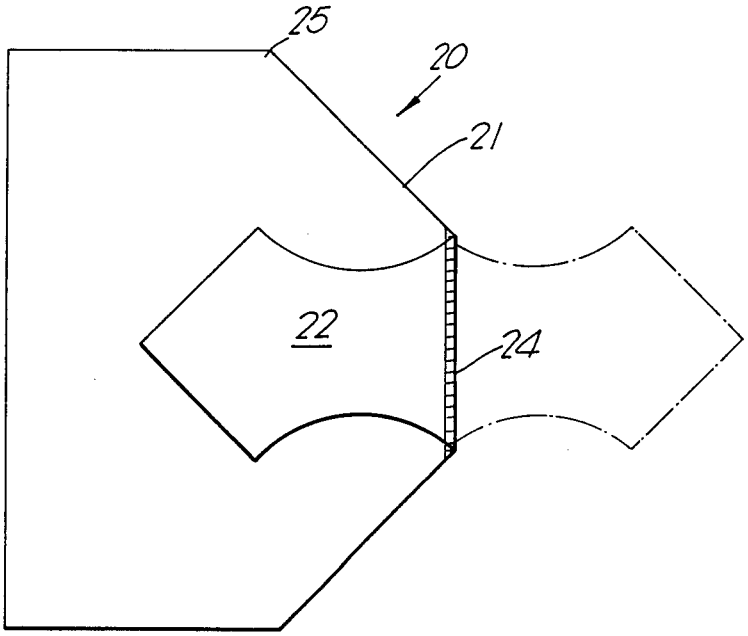
FIG. 1 is a plan of a piece of material which is to be unfolded.
Figure 2:
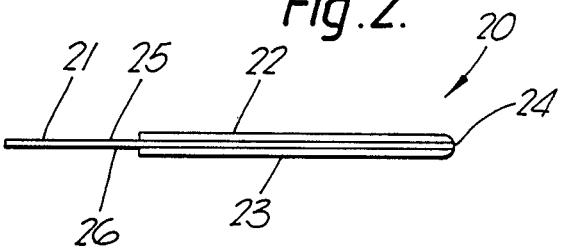
FIG. 2 is a side view of the piece of material shown in FIG. 1.
Figure 3:
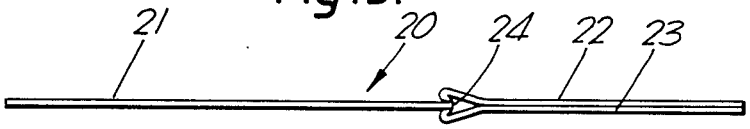
FIG. 3 is a side view of the piece of material shown in FIG. 1, when unfolded.

A piece of material comprising a garment part 20, in this case a component of a pair of men's underpants is shown in FIGS. 1, 2 and 3. The garment part 20 comprises a first piece of material 21 constituting the rear part of the underpants, and second and third pieces of material 22 and 23, respectively, constituting portions of the front part of the underpants and identically shaped. The pieces of material 21, 22 and 23 constituting the garment part 20 are seamed together along superposed edges 24 and in the condition shown in full lines in FIGS. 1 and 2, the pieces of material 22 and 23 lie adjacent opposite surfaces 25 and 26 of the first piece of material 21. In FIGS. 1 and 2, the garment part 20 is in a folded condition, that is the pieces of material 22 and 23 are folded to lie against the surfaces of the piece of material 21. However, when the garment part 20 is passed to the next stage of assembly of the underpants it must be opened out as shown in FIG. 3 (and in broken lines in FIG. 1) so that the pieces of material 22 and 23 are unfolded from the piece of material 21. This unfolding is accomplished by the apparatus illustrated in FIGS. 4 to 11.

This apparatus which constitutes a work station for carrying out an operation, in this case an unfolding operation, on garment parts 20 and which will normally be one of a series of work stations, comprises a frame 30 (FIG. 6) carrying a table top 31 which provides a supporting surface 32 for garment parts 20. The table top 31 is set in a larger table top 33 which provides a further part of the supporting surface 32. The garment parts 20 can be moved over the surface 32 by sliding them to and from work stations at which various operations may be performed on them. The extent of the table top will depend on the number of operations which are to be carried out on the garment parts and thus the number of work stations which have to be accommodated in or about the surface 32.

Figure 4:
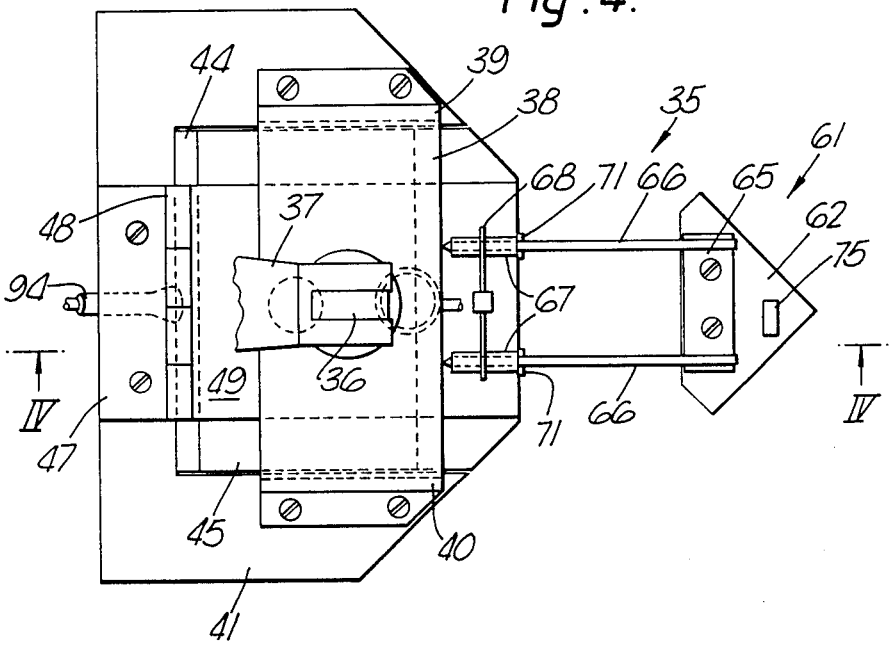
FIG. 4 is a plan of a presser head in an apparatus according to the invention.
Figure 5:
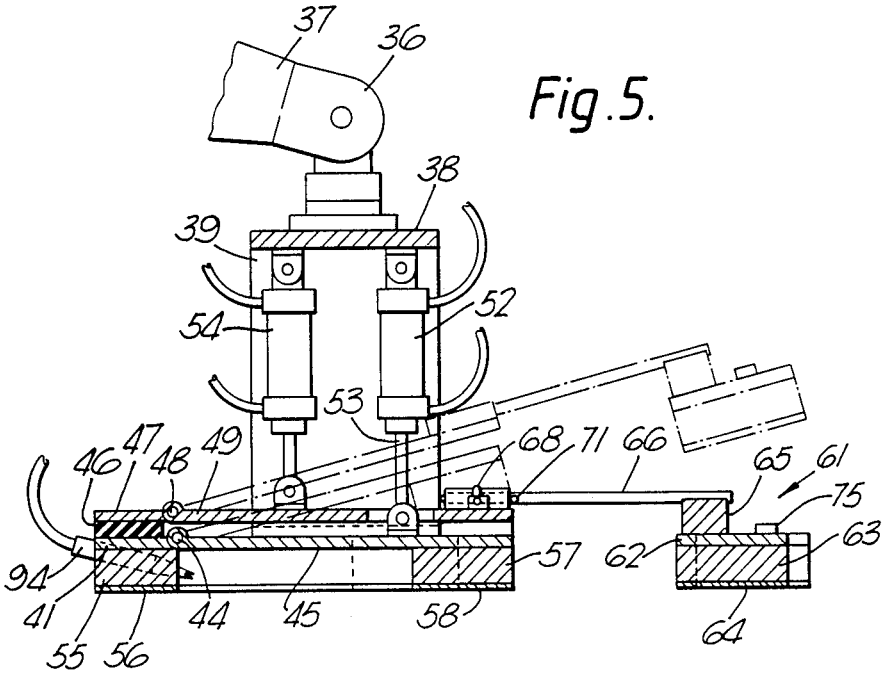
FIG. 5 is a section on the line IV—IV of the presser head of FIG. 4.
Figure 8:
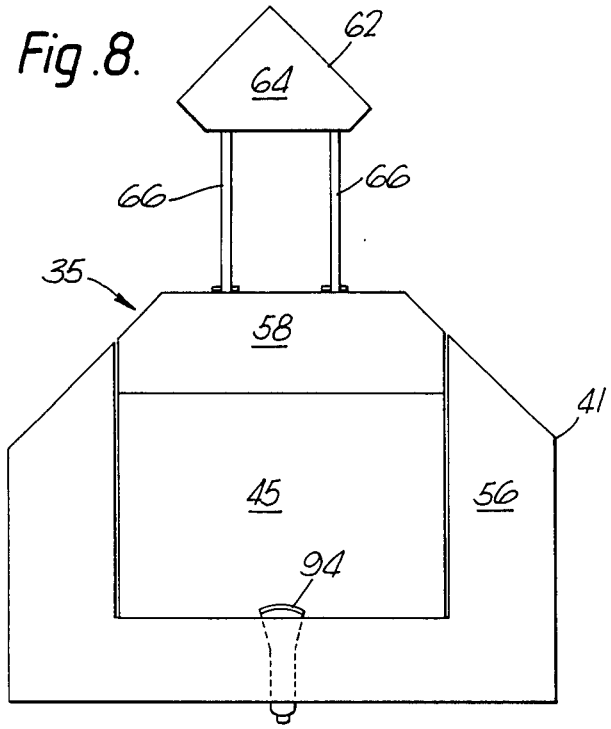
FIG. 8 is a view from below of the presser head shown in FIG. 4, and FIGS. 9, 10 and 11 are sections showing part of the apparatus of FIG. 6 and illustrating three stages in its operation.

Movement of the garment parts 20 over the surface 32 is effected, in the present example of the invention, by a presser element constituted by a presser head 35 (see especially FIGS. 4,5 and 8). The head 35 is mounted by a universal joint 36 on the end of a robot arm 37. The universal joint 36 is secured to an upper plate 38 of the head 35 and side plates 39 and 40 integral with and depending from the plate 38 are secured by screws to a U-shaped base-plate 41 of the head 35. Hinged to the U-shaped base-plate 41 by a hinge 44 is a rectangular plate 45. Secured to the base-plate 41 by screws and spaced therefrom by a spacing strip 46, is a hinge plate 47 carrying a hinge 48 by which a rectangular plate 49 is hingedly mounted on the base-plate 41.

Between the plate 45 and the plate 38 is connected a double-acting air-operated piston and cylinder unit 52 the piston rod 53 of which extends through an aperture in the plate 49. Between the plate 49 and the plate 38 is connected a double-acting air-operated piston and cylinder unit 54.

The undersurface of the U-shaped base-plate 41 carries a block of foamed synthetic plastics material 55 and the undersurface of the foamed synthetic plastics material 55 is covered with a layer 56 of synthetic rubber. The front edge region of the plate 45 carries a block of foamed synthetic plastics material 57 having its undersurface covered with a layer 58 of synthetic rubber. The presser head 35 thus has a cushioned undersurface which presents to a garment part 20, on which the presser head is superposed, a surface (layers 56 and 58) having good frictional properties and able reliably to push the garment part about over the table tops 33 and 31.

An auxiliary presser element 61 can be attached to the presser head 35 and comprises an approximately triangular plate 62 carrying a block of foamed synthetic plastics material 63 and a layer of synthetic rubber 64. Screwed to the upper surface of the plate 62 is a metal block 65 to which are secured two metal rods 66 releasably engagable in sockets 67 located at the front edge of the plate 49. A resilient bar 68 secured on the plate 49 engages in a slot in each of the sockets 67 and, when the rods 66 are engaged in the sockets 67, locates in grooves 69 (FIG. 7) in the rods 66 releasably to retain the rods in the sockets. Pins 71 projecting from the rods 66 limit their movement into the sockets 67.

A detent 72 pivotally mounted on stanchions 73 on a plate 60 secured on the table top 31 and movable by a double-acting air-operated piston and cylinder unit 74 engages an abutment 75 on the auxiliary element 61 to retain the auxiliary element in a rest position on the table top 31. Operation of the piston and cylinder unit 74 to lift the detent 72, releases the auxiliary element 61 and allows it to move with the presser head 35 if the rods 66 are engaged in the sockets 67 and retained therein by the bar 68. Correct location of the auxiliary element 61 in its rest position is achieved by means of stops 59 mounted on the plate 60 carrying the detent 72 and the piston and cylinder unit 74.

Figure 9:
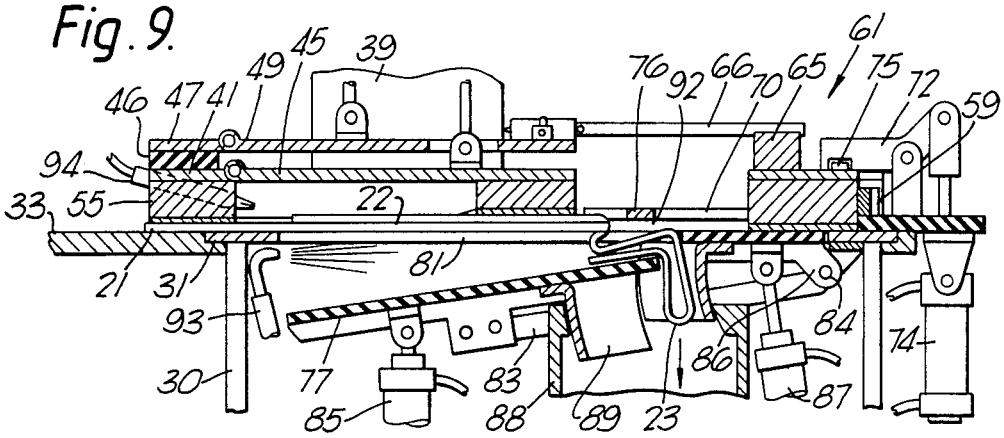

Supported on two rods 70 adjustably secured in blocks 82 on the table top 31, and located above and approximately centrally of the table top 31, is a curved metal strip 76. Set into a central aperture in the table top 31 and level with the table top are plates 77 and 78 with adjacent parallel curved edges 79 and 80 located slightly forward of the curved strip 76. The upper surfaces of the plates 77 and 78 constitute parts of the surface 32 for supporting the garment parts 20, other parts of which are constituted by the table tops 31 and 33. The plate 77 is supported at its sides on arms 83, only one of which is visible in FIG. 6. The arms 83 are pivoted on the table top 31 about an axis 84. Connected between the table top 31 and the plate 77 is a double-acting air-operated piston and cylinder unit 85. The plate 77 can be lowered about the axis 84, as shown in FIG. 9.

Figure 6:
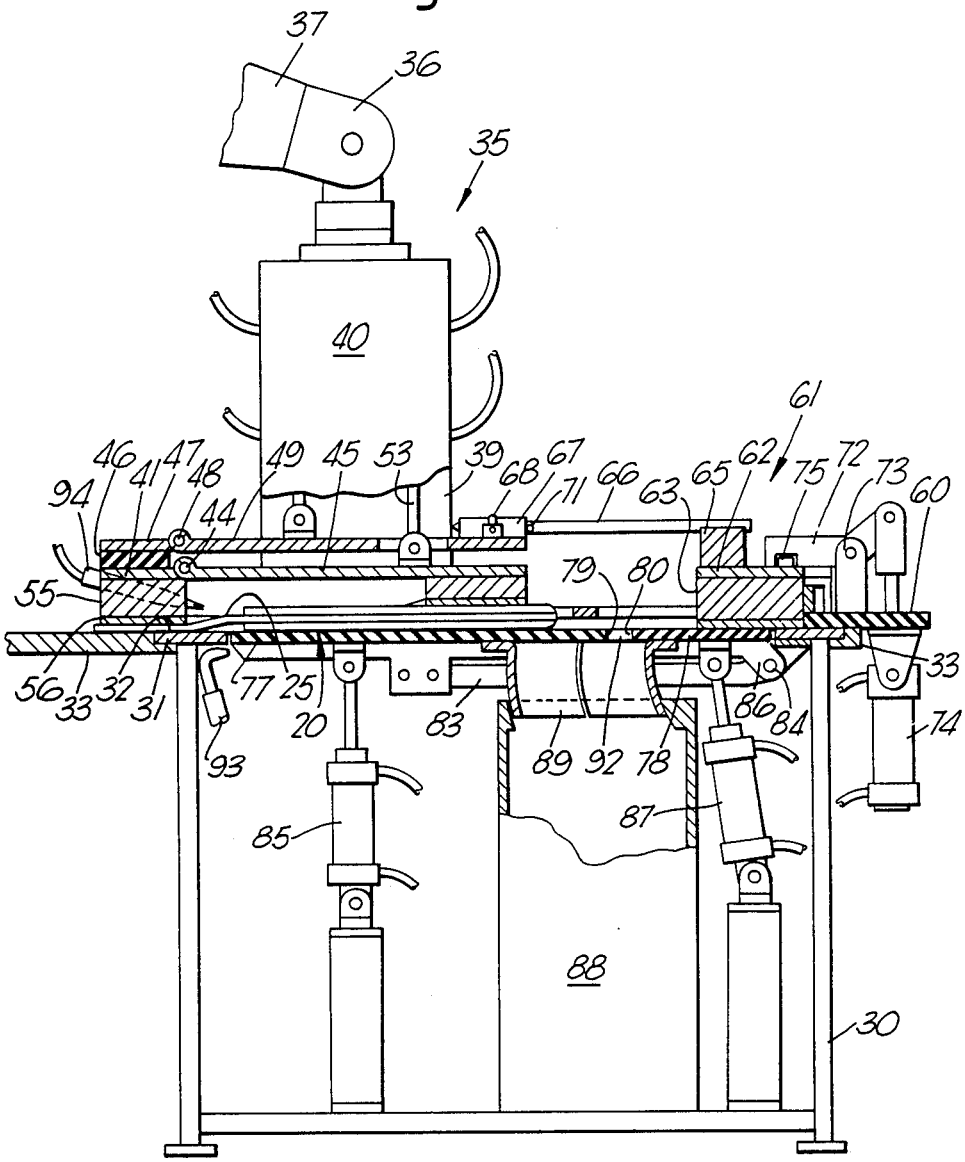
FIG. 6 is a section through an apparatus according to the invention.
Figure 7:
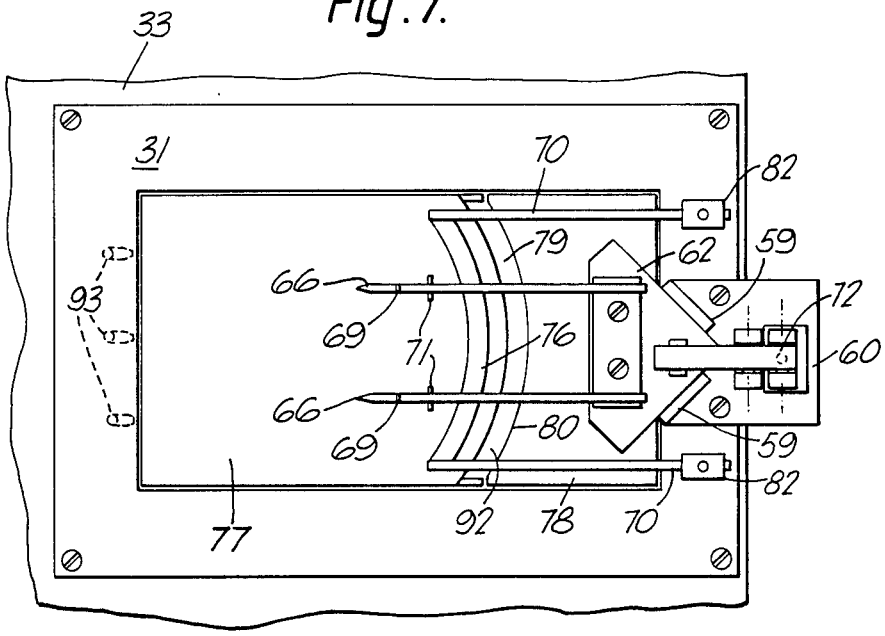
FIG. 7 is a plan of the apparatus of FIG. 6 with the presser head of FIGS. 4 and 5 and the piece of material removed
Figure 10:
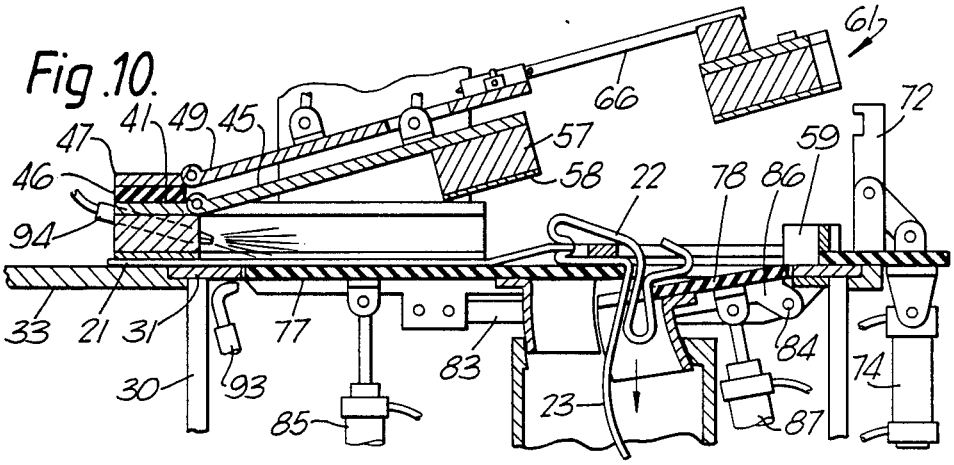

The plate 78 has secured to it two lugs 86, only one of which is visible in FIG. 6, also pivoted on the table top 31 about the axis 84 and a double-acting air-operated piston and cylinder unit 87 is connected between the frame 30 and the plate 78 so that by suitable operation of the unit 87, the plate 78 can be lowered about the axis 84 as shown in FIG. 10.

A housing 88 connected to a suction unit (not shown) is mounted on the frame 30 and a split duct 89, part of which is mounted beneath the plate 77 and part of which is mounted below the plate 78, is engaged in the upper open rectangular end of the housing 88 and communicates with an aperture 92 between the curved adjacent edges of the plates 77 and 78 so that suction can be applied to the aperture 92.

The operation of the apparatus described above is as follows:

The presser head 35, under control of the robot arm 37, is imposed upon a garment part 20 which at this stage is in a folded condition as shown in FIGS. 1 and 2. Typically, this garment part 20 will have been produced by superposing first, second and third pieces of material 21, 22 and 23 and seaming them together along the edges 24.

The seaming operation may be effected by using the presser head 35 to move the superposed pieces of material 21, 22 and 23 through a sewing head or another device may be used to carry the pieces of material through the seaming operation after which the presser head 35 is imposed on the seamed garment part 20 on a part of the table top 33 (which is not shown) spaced from the unfolding apparatus of FIGS. 4 to 11 and the presser head 35 would then serve merely to transport the garment part 20 to the unfolding apparatus by pushing the garment part over the table top 33.

Comparing FIGS. 1 and 8 of the drawings, it can be seen that the shape of the undersurface of the presser head 35 conforms to the shape of the folded garment part 20 and the location of the blocks of foamed material and the layers 56 and 58 of synthetic rubber for engaging the garment part 20 are such that the whole of the peripheral region of the garment part 20 is engaged by the presser head 35.

The presser head 35 brings the garment part 20 over the table top 33 to the position shown in FIG. 6 where the garment part 20 rests partly on the table top 33, partly on the table top 31 and partly on the plate 77. This movement of the presser head 35 is arranged so that, at least in the final stages of its movement, the presser head presents the sockets 67 to the rods 66 so that the rods 66 engage in the sockets 67 and are releasably clamped there by the resilient bar 68, thus temporarily attaching the auxiliary element 61 to the presser head 35. The piston and cylinder unit 85 is then operated to lower the plate 77 by pivoting about the axis 84 and compressed air is supplied to three nozzles 93 at spaced locations near the rear edge of the plate 77. Lowering the plate 77 releases the piece of material 23 which is smaller in area than the piece of material 21 and allows it to fall through the aperture 81 thus revealed in the table top 31, leaving the piece of material 21 held by its peripheral regions between the presser head 35 and the regions of the table top 31 surrounding the plate 77. The current of air from the nozzles 93 carries the piece of material 23 across the plate 77, beneath the curved strip 76 and into the now widened aperture 92 between the plates 77 and 78. The piece of material 23 is drawn through the aperture 92 by a current of air created by applying suction to the housing 88. FIG. 9 shows a condition part way through this stage of the unfolding operation when part of the piece of material 23 has passed through the aperture 92.

In the next stage of the unfolding operation, shown in FIG. 10, the air supply to the nozzles 93 is turned off, the piston and cylinder unit 85 is operated to return the plate 77 to its horizontal position flush with the table top 31 and the piston and cylinder unit 74 is operated to raise the detent 72. The piston and cylinder units 52 and 54 are also operated to raise the plate 45 as well as the plate 49, together with the auxiliary element 61, by pivoting about the hinges 44,48. Displacing the part of the presser head 35 constituted by the plate 45 and the foamed synthetic plastics material 57 releases the piece of material 22 for movement by an air current as will be described below. The piston and cylinder unit 87 is now operated to lower the plate 78 by pivoting about the axis 84 and compressed air is supplied to a fan shaped nozzle 94 which extends through the block of foamed material 55 at the rear of the presser head 35. Located above the table top 31, the nozzle 94 directs a current of air above the piece of material 21, which is still held against the table top 31 (and table top 33) by the presser head 35 at a region remote from the junction of the pieces of material 21 and 22 at the edges 24. The current of air carries the piece of material 22 forwards over the curved strip 76 where a current of air entering the housing 88 through the duct 89 and aperture 92, and created by applying suction to the housing 88, causes the piece of material 22 to enter the duct 89 (and then the housing 88) through the aperture 92, which is, at this juncture, enlarged by lowering of the plate 78. The curved strip 76 acts as a separating guide for the pieces of material 22 and 23 which are now located on opposite sides of (one above and one below) the strip 76.

Figure 11:
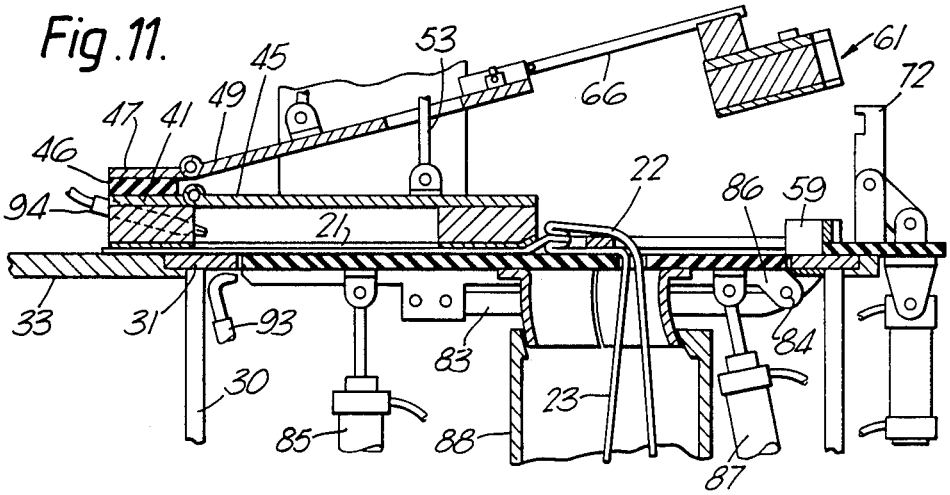

Next, the air supply to the nozzle 94 is turned off and the plate 78 is raised by operation of the piston and cylinder unit 87. Piston and cylinder unit 52 is next operated to lower the plate 45 so that the block of foamed material 57 and the layer of synthetic rubber 58 again press the front edge of the piece of material 21 against the plate 77 as shown in FIG. 11. Finally, the presser head 35 is moved away to the left in FIG. 11, suction still being applied to the housing 88 with the result that the pieces of material 22 and 23 are drawn out of the housing 88, over the curved strip 76 and the front edge of the plate 77 respectively, against the resistance of a flow of air into the housing 88 created by the suction applied to the housing. The pieces of material 22 and 23 are thus drawn out of the housing 88 in a wrinkle free condition and are laid out flat on the plate 77 and table top 33 (and possibly partly on the table top 31) with the piece of material 22 superposed on the piece of material 23. The piston and cylinder unit 54 is then operated to lower the plate 49 and the auxiliary element 61 so that the auxiliary element presses the pieces of material 22 and 23 against the plate 77, the shape and location of the plate 62 of the auxiliary element 61 and the foamed material and layer of synthetic rubber 64 attached to the plate 62 being such that the auxiliary element 61 presses the forward peripheral regions of the pieces of material 22 and 23 against the plate 77. The garment part 20 is thus held and controlled by the presser head 35 and auxiliary element 61, at this stage, so that it can be moved in any direction over the table top 33 and at the same time will be maintained in a flat wrinkle-free condition in its now unfolded state. The garment part 20 can thus be delivered to another sewing machine or to another device for completion of a further operation in the production of a garment.

The auxiliary element 61 can be returned by the presser head 35, moving always under control of the robot arm 37, to its rest position on the table top 31. To achieve this return, the presser head 35, with the plate 49 lowered, is moved to the position shown in FIG. 6 (although of course the garment part 20 will now be absent), with the detent 72 raised. The piston and cylinder unit 74 is operated to lower the detent 72 onto the abutment 75 and the presser head is withdrawn to the left in FIG. 6 so that the rods 66 pull out of the sockets 67 thus detaching the auxiliary element 61 from the presser head 35. The presser head can then be used to carry out operations for which it does not require the auxiliary element 61 or which it could not perform with the auxiliary element attached to it. If the presser head 35 is not required to carry out any such operations, the auxiliary element 61 may be permanently attached to it. The shapes of the surfaces of the presser head 35 and auxiliary presser element 61 (if present) which contact a garment part to be manipulated will be altered to conform to the shape of the garment part if different from that shown in the accompanying drawings.

The detent 72 and the related parts which receive and locate the auxiliary presser element 61 when the auxiliary presser element is out of use may be situated at a location other than that shown in the drawings. In this case, the presser head 35 will be presented to the auxiliary presser element 61 in its rest location in order to pick up the auxiliary presser element 61 and attach it to the presser head 35 by engagement of the rods 66 in the sockets 67 before the presser head 35 (together with the auxiliary presser element 61) are moved by the robot arm to the position shown in FIG. 6.

If the apparatus shown in the drawings is a unit of a production line for assembling garment parts, a presser head controlled by another robot (not shown) and shaped to conform to the shape of the garment parts at that stage of the assembly procedure may be used to move the garment parts for unfolding to a position where they can be reached by the presser head 35. The same or a further presser head may remove them when the unfolding operation has been carried out. If this arrangement is adopted, the presser head 35 could be moved by a dedicated device instead of a robot. Such a device could be adapted merely to move the presser head 35 along a straight line between the position shown in FIG. 6 and a position at which the presser head 35 collects the garment part 20 to move it to the position shown in FIG. 6.

What is claimed is:

1. A method of unfolding a doubled piece of flexible material comprising a first piece of material and further piece of material disposed adjacent a surface of the first piece of material, which method comprises the steps of holding the said first piece of material in a region remote from a junction of said first piece of material and said further piece of material, leaving said further piece of material free and creating an air current to move the said further piece of material away from the said surface of the first piece of material.

2. A method according to claim 1, wherein said first piece of material is held in said region remote from said junction by supporting said first piece of material on a surface and clamping said first piece of material against the said surface by a presser element pressing it against the said surface.

3. A method according to claim 2, wherein said first piece of material is clamped against said surface in a region located about the periphery of an aperture through which the said further piece of material can move before being moved by said air current.

4. A method according to claim 2, wherein when said further piece of material has been moved away from said surface of the first piece of material, the said first piece of material is moved over said supporting surface in a direction away from said further piece of material causing said further piece of material to rest on said supporting surface in a flat condition extending away from said first piece of material.

5. A method according to claim 1, in which said doubled piece of material comprises another piece of material lying adjacent a surface of the said first piece of material remote from said further piece of material comprising the step of creating an air current to move said other piece of material away from said surface of the first piece of material.

6. A method according to claim 5, wherein said further piece of material and said other piece of material are moved away from said first piece of material on opposite sides of a separating guide.

7. A method according to claim 6, comprising the step of applying suction to said further piece of material and to said other piece of material so that they extend from said first piece of material on opposite sides of said guide into a housing.

8. Apparatus for unfolding a doubled piece of flexible material comprising a first piece of material and a further piece of material disposed adjacent a surface of the first piece of material, which apparatus comprises a presser element for pressing the folded piece of material against a supporting surface, at least one displaceable part of the presser element being displaceable to release the said further piece of material for movement away from said first piece of material by means producing an air current.

9. Apparatus according to claim 8, wherein said presser element has attached to it an auxiliary presser element for pressing said further piece of material against a further surface after unfolding.

10. Apparatus according to claim 9, wherein said auxiliary presser element is releasably attachable to said presser element.

11. Apparatus according to claim 8, comprising a housing and suction means to draw said further piece of material into said housing after it has been moved away from the said first piece of material by said air current.

12. Apparatus according to claim 8 for unfolding a doubled piece of material having another piece of material disposed adjacent a surface of said first piece of material remote from said further piece of material, which apparatus comprises means producing a further air current to move said other piece of material away from said first piece of material.

13. Apparatus according to claim 12, comprising a separating guide on opposite sides of which said further piece of material and said other piece of material are moved away from said first piece of material.

14. Apparatus according to claim 13, comprising means for applying suction to said further piece of material and to said other piece of material so that these two pieces of material extend from said first piece of material on opposite sides of said guide into a housing.

15. Apparatus according to claim 8, comprising means operative, after said further piece of material has been moved away from said surface of said first piece of material, to move said first piece of material over said supporting surface in a direction away from said further piece of material, thereby causing said further piece of material to rest on said supporting surface in a flat condition extending away from said first piece of material.

16. Apparatus according to claim 15, comprising an element to grip said further piece of material against said supporting surface in the unfolded state of said further piece of material.

* * * * *